US005540792A

United States Patent [19]

Quadakkers et al.

[11] Patent Number: 5,540,792

[45] Date of Patent: Jul. 30, 1996

[54] COMPONENTS BASED ON INTERMETALLIC PHASES OF THE SYSTEM TITANIUM-ALUMINUM AND PROCESS FOR PRODUCING SUCH COMPONENTS

[75] Inventors: Willem J. Quadakkers, Wijnandsrade, Netherlands; Alexander Gil, Chrzanow, Poland

[73] Assignee: Forschungszentrum Julich GmbH, Julich, Germany

[21] Appl. No.: 325,289

[22] PCT Filed: May 11, 1993

[86] PCT No.: PCT/DE93/00450

§ 371 Date: Oct. 25, 1994

§ 102(e) Date: Oct. 25, 1994

[87] PCT Pub. No.: WO93/23582

PCT Pub. Date: Nov. 25, 1993

[30] Foreign Application Priority Data

May 12, 1992 [DE] Germany ..... 42 15 017.5

[51] Int. Cl.[6] ..... C22C 14/00; C22F 1/18

[52] U.S. Cl. ..... 148/669; 148/407; 148/421; 420/418

[58] Field of Search ..... 148/669, 407, 148/421; 420/418

[56] References Cited

FOREIGN PATENT DOCUMENTS

| | | | |
|---|---|---|---|
| 0365174A1 | 4/1990 | European Pat. Off. . | |
| 0521516A1 | 1/1993 | European Pat. Off. . | |
| 2250931 | 8/1990 | Japan . | |
| 3199358 | 8/1991 | Japan . | |
| 4063237 | 2/1992 | Japan . | |
| 4124236 | 4/1992 | Japan . | |
| 4218649 | 10/1992 | Japan . | |
| 6-145933 | 5/1994 | Japan | 148/669 |

OTHER PUBLICATIONS

Binary Alloy Phase Diagrams, Second Edition, vol. I, pp. 225–226, 1990.

*Primary Examiner*—John Sheehan
*Attorney, Agent, or Firm*—Herbert Dubno

[57] ABSTRACT

A titanium aluminide component is disclosed based on intermetallic phases of the system titanium-aluminum and having an aluminum content between 42 at. Percent and 53 at. Percent. The titanium aluminide component has on its surface a lamellar, eutectoid $Ti_3Al/TiAl$ structure. Also disclosed is a process for preparing the titanium aluminide component.

12 Claims, No Drawings

COMPONENTS BASED ON INTERMETALLIC PHASES OF THE SYSTEM TITANIUM-ALUMINUM AND PROCESS FOR PRODUCING SUCH COMPONENTS

The invention relates to a component according to the introductory part of claim 1. Further the invention relates to a process for producing such components based on intermetallic phases of the system titanium-aluminum with an aluminum content between 42 at. % and 53 at. %.

Presently there is an increasing interest in intermetallic phases as a potentially suitable construction material for components subjected to high stress at high process temperatures. Particularly the intermetallic phases based on titanium-aluminide can be put to a variety of uses because of their good strength at high temperatures combined with low density, e.g. in such cases when the mechanical component stress is partially-related to the occurrence of centrifugal forces. As an example turbine blades can be mentioned in this context.

Of importance in this connection are first of all titanium aluminides with an aluminum content ranging between 42–53 at. %, particularly within the range of 45–50 at. %, in view of their good mechanical properties. The phase diagram of the system titanium aluminum shows in this range of aluminum concentration the intermetallic phases $Ti_3Al$ and TiAl. However these materials have a poor resistance against oxidation, respectively corrosion, manifesting itself negatively in components produced on this base at operational temperatures between 700° C. and 900° C. The cause of this drawback resides in the fact that the mentioned titanium aluminides at these temperatures do not form a protective, stable oxide layer based on $Al_2O_3$, in spite of their high aluminum content. Instead, especially after longer periods of oxidation, layers based on $TiO_2$ are in fact formed, which have a high oxidation rate. This leads to a quick loss of component wall thickness, thereby damaging the component made of such a material.

From the materials technology in the field of high-temperature materials, e.g. such as those based on NiCrAl, oxidation-inhibiting protective coatings are known, e.g. of the type Ni(Co)CrAlY. However such protective coatings when applied to titanium aluminide could have a negative influence on the material properties of this material, particularly due to interdiffusion processes which can drastically reduce the mechanical properties of the material, particularly its resistance against mechanical loading. Furthermore such protective coatings always have flaws due to conditions of manufacturing and/or operation, such as pores or cracks, which can lead to strong local corrosion of the material —here titanium aluminide—covered by this protective layer.

Finally it is known to improve material surfaces through the so-called aluminizing process, wherein the aluminum content of such a surface is enriched. At first this leads to improved oxidation characteristics, but thereby disadvantageously the intermetallic phase TiAl3 is formed which has a strong tendency to crack. As a result the component subjected to this surface treatment is prone to cracking, respectively brittleness.

It is therefore the object of the invention to create a component of the above-mentioned kind wherein the good mechanical characteristics of the titanium aluminide are defined and the requirements of oxidation and corrosion resistance at process temperatures up to 900° C. can be insured. Furthermore it is the object of the invention to create a process for producing a component of the above-mentioned kind, wherein a reproducible production of such components is made possible without the aforementioned disadvantages.

It has been found that the oxidation resistance of titanium aluminides with aluminum contents between 42 and 53 at. % aluminum depends not only on the exact composition of the material, respectively the alloy, but rather on the microstructure. When exposed in the above-mentioned temperature range of up to 900° C., particularly of 700°–900° C., a titanium aluminide with given composition can form a slow growing $Al_2O_3$ layer as well as a rapidly growing $TiO_2$ layer, depending on the respective structure.

It has been found that through an eutectoid reaction ($Ti_3Al$ and TiAl) an alloy microstructure is produced which leads to the formation of an $Al_2O_3$ layer in components made of this material during high temperature exposure.

It has been further established that the titanium aluminide in the case where besides such an eutectoid structure also primary and secondary precipitated TiAl phases are present in the surface area, these materials at high temperatures up to 900° C. lead locally to the formation of a $TiO_2$ layer, which after a longer period of precipitation spreads over the entire surface of the material in a disadvantageous manner.

It has been proven that the formation of the $Al_2O_3$ layer which is favorable for the oxidation and corrosion resistance of the material is insured when the component made of titanium aluminide shows a surface structure with a complete eutectoid reaction, with a lamellar $Ti_3Al$/TiAl structure.

Thereby two alternative possibilities are available for achieving such a component:

Starting from a titanium aluminide melt with an aluminum content between 42–53 at. % the desired microstructure can be obtained directly on the surface of the component through sufficiently rapid cooling.

For the case that the component produced through slow cooling from the melt has not yet achieved the desired lamellar eutectoid structure, such as is generally the case with a material, respectively component produced through conventional casting or forging, the component can be appropriately subjected to heat treatment which after a subsequent, sufficiently quick cooling, can bring about the desired microstructure on the surface of such a component.

For this purpose the component is subjected to heat treatment at an advantageous temperature , so that according to the Ti—Al phase diagram only α-Ti is possibly present. The optimal heat treatment temperature should be at least as close as possible to the stability range of α-Ti in the phase diagram, depending on the composition of the titanium aluminide. If the starting material of the component is not a binary titanium aluminide, but contains further ternary or quaternary alloy additions, the most appropriate temperature for the heat treatment can be experimentally established.

In a suitable development of the process of the invention the heat treatment temperature is selected within the range of 1300° C.–1430° C., particularly at 1400° C.

Depending on the selection of the heat treatment temperature, the duration of the heat treatment should appropriately be up to several hours, e.g. up to 4 hours, particularly between 30 minutes and 4 hours.

In an advantageous embodiment of the process of the invention an additional heat treatment of the surface of the already heat-treated component is taught. This is of particular importance if the lamellar eutectoid structure produced on the surface of the component by the first heat treatment is not complete. It is for instance conceivable that the surface of the component first subjected to heat treatment is being processed mechanically, so that the previously obtained lamellar structure is partially removed from the component to a smaller or larger extent, e.g. by mechanical means. Thereby such an additional heat treatment can be carried out particularly in surface areas which no longer have the desired microstructure.

In an advantageous variant of the process of the invention a locally defined heat treatment by means of a laser, an electronic beam or a high-frequency induction coil is proposed. It is also possible to use a combination of these methods of surface treatment. In this process a surface zone of up to 100 μm or more can be locally melted or heated up to sufficiently high temperatures depending on the desired thickness of the lamellar surface structure, especially in the above-mentioned stability range of the α-Ti, such as for instance 1400° C. Depending on the required mechanical or corrosion resistance characteristics of the component, the width of the heat-treated surface zone can be established in a controlled manner. For instance a small width of this zone has the advantage that the bulk of the component is influenced as little as possible in respect to its mechanical properties. On the other hand at the same time it is insured that by introducing a small amount of heat the desired high cooling rate is reached already by a normal air cooling. Thereby it can be advantageous to increase the cooling rate by means of an additional separate gas cooling.

An advantageous variant of the process of the invention results finally for the case when the component is subjected to heat treatment by means of a high-frequency heating device, particularly with the assistance of a high-frequency induction coil. Thereby this component is moved through the coil with a suitable speed, depending on the desired penetration depth of the surface structure of finely lamellar, eutectoid $Ti_3Al/TiAl$ structure. Thereby it is possible to set a locally defined penetration depth of the favorable lamellar structure depending on the required mechanical and/or corrosion resistance characteristics of the component.

Besides the mentioned surface treatment methods can also be used for the primary coating of a component according to the invention with a structure built in the desired manner. Thereby these methods are not limited to the use for a further heat treatment after the primary heat treatment.

We claim:

1. A titanium aluminide component which can be subjected to high mechanical stress and which has a long-lasting resistance to oxidation and corrosion while exposed to process temperatures of up to 900° C., which comprises an intermetallic phase of a titanium-aluminum system with an aluminum content between 42 at.% and 53 at.%, wherein the surface of the titanium aluminide component has a lamellar eutectoid $Ti_3Al/TiAl$ microstructure at a locally defined desired penetration depth, which results in formation of a protective, stable $Al_2O_3$ layer during said process temperature exposure.

2. A process for producing a titanium aluminide component which can be subjected to high mechanical stress and which has a long-lasting resistance to oxidation and corrosion while exposed to process temperatures of up to 900° C., and which comprises an intermetallic phase of a titanium-aluminum system with an aluminum content between 42 at.% and 53 at.%, wherein the surface of the titanium aluminide component has a lamellar eutectoid $Ti_3Al/TiAl$ microstructure at a locally defined desired penetration depth, which results in formation of a protective, stable $Al_2O_3$ layer during said process temperature exposure, which comprises the steps of:

(a) forming a titanium aluminide melt with an aluminum content between 42 to 53 atomic percent; and (b) quenching the titanium-aluminum melt to form the titanium aluminide component and to obtain on the surface of said component the desired lamellar eutectoid $Ti_3Al/TiAl$ microstructure at a locally defined desired penetration depth.

3. A process for producing a titanium aluminide component which can be subjected to high mechanical stress and which has a long-lasting resistance to oxidation and corrosion while exposed to process temperatures of up to 900° C., and which comprises an intermetallic phase of a titanium-aluminum system with an aluminum content between 42 at.% and 53 at.%, wherein the surface of the titanium aluminide component has a lamellar eutectoid $Ti_3Al/TiAl$ microstructure of a locally defined desired penetration depth, which results in formation of a protective, stable $Al_2O_3$ layer during said process temperature exposure, which comprises the steps of:

(a) forming a titanium aluminide melt with an aluminum content between 42 to 53 atomic percent;

(b) quenching the titanium-aluminum melt to form a titanium aluminide component whose surface does not have the desired lamellar eutectoid $Ti_3Al/TiAl$ microstructure of a locally defined desired penetration depth;

(c) heat-treating the surface of the titanium aluminide component whose surface does not have the desired lamellar eutectoid $Ti_3Al/TiAl$ microstructure of a locally defined desired penetration depth; and (d) subsequently quenching the titanium aluminide component heat-treated according to step (c) to bring about the desired microstructure of a locally defined desired penetration depth on the surface of the titanium aluminide component.

4. The process defined in claim 3 wherein according to step (c) the heat treatment takes place at a temperature which is in or as close as possible to the stability range of the alpha-titanium in the titanium-aluminum phase diagram.

5. The process defined in claim 3 wherein according to step (c) the heat treatment takes place at a temperature of 1100° to 1430° C.

6. The process defined in claim 3 wherein according to step (c)the heat treatment takes place at a temperature of 1400° C.

7. The process defined in claim 3 wherein according to step (c) the heat treatment has a duration of up to 4 hours.

8. The process defined in claim 3 wherein according to step (c) the heat treatment has a duration of 30 minutes to 4 hours.

9. The process defined in claim 3 which further comprises the step of subjecting the titanium aluminide component which has a lamellar eutectoid $Ti_3Al/TiAl$ microstructure at a locally defined desired penetration depth to an additional heat treatment when the lameliar eutectoid $Ti_3Al/TiAl$ microstructure at a locally defined desired penetration depth is incomplete or has been partially removed.

10. The process defined in claim 3 wherein according to step (c) the surface of the titanium aluminide component is subjected to a locally defined heat treatment.

11. The process defined in claim 3 wherein according to step (c) the heat treatment is performed by means of a laser, an electronic beam or a high frequency induction coil or by a combination of these methods.

12. The process defined in claim 11 wherein the heat treatment is carried out by means of the high frequency induction coil, the titanium aluminide component is moved through the coil with an appropriate speed depending on the respective locally defined desired penetration depth of the fine lameliar, eutectoid $Ti_3Al/TiAl$ microstructure of the surface structure.

* * * * *